US007214136B1

(12) United States Patent
Perry et al.

(10) Patent No.: US 7,214,136 B1
(45) Date of Patent: May 8, 2007

(54) METHOD AND APPARATUS TO PRACTICE GOLF SWING

(76) Inventors: Jasper Perry, 9505 Lazy River Dr., Las Vegas, NV (US) 89117; Timothy M. Crawley, 5822 W. Purdue Ave., Glendale, AZ (US) 85302

( * ) Notice: Subject to any disclaimer, the term of this patent is extended or adjusted under 35 U.S.C. 154(b) by 0 days.

(21) Appl. No.: 11/374,810

(22) Filed: Mar. 15, 2006

(51) Int. Cl.
*A63B 69/39* (2006.01)

(52) U.S. Cl. ..... 473/139; 473/145

(58) Field of Classification Search ..... 473/139, 473/140, 141, 142–149
See application file for complete search history.

(56) References Cited

U.S. PATENT DOCUMENTS 1,528,739 A * 3/1925 Boyce ..... 473/147
5,121,923 A * 6/1992 D'Allura ..... 473/140
5,685,542 A * 11/1997 Weis ..... 473/459
6,146,283 A * 11/2000 Ferguson, III ..... 473/145
6,425,830 B1 * 7/2002 Chou ..... 473/140

* cited by examiner

*Primary Examiner*—Nini F. Legesse
(74) *Attorney, Agent, or Firm*—Tod R. Nissle, P.C.

(57) ABSTRACT

An apparatus and method are provided for practicing a golf swing. The apparatus includes a rotationally mounted golf ball, the movement of which is slowed by movement of a piston against a spring and through a liquid. A valve mechanism incorporated in the apparatus facilitates movement of the piston in one direction and retards movement of the piston in an opposite direction.

1 Claim, 2 Drawing Sheets

15
10
14
12
16
11
13
A
B
C
17
19
18
21
11
15A

METHOD AND APPARATUS TO PRACTICE GOLF SWING

This invention pertains to a method and apparatus for practicing a sport.

More particularly, this invention pertains to an apparatus and method for practicing a golf swing.

A variety of apparatus and methods have been developed to practice a golf swing.

It would be desirable to provide an improved golf swing apparatus that would permit a golf ball—after being struck by a golf club—to rotate about a fixed axis and that would quickly, and safely return a golf ball to an at rest position in which the golf ball could be struck yet again.

Therefore, it is a principal object of the invention to provide an improved method and apparatus for practicing a golf swing.

A further object of the invention is to provide an improved method and apparatus for practicing a golf swing in which movement of a golf ball is quickly retarded so that the ball is ready to be struck again by a golfer.

These and other, further and more specific objects and advantages of the invention will be apparent from the following detailed description of the invention, taken in conjunction with the drawings, in which.

Briefly, in accordance with my invention, I provide an improved apparatus for practicing a golf swing. The apparatus comprises a base; a chamber mounted on the base; dampening apparatus in the chamber; a piston in the chamber for reciprocation therein, the dampening apparatus retarding movement of the piston in the chamber; a golf ball unit; an elongate arm having a first end connected to the golf ball unit and having a second end; a shaft unit pivotally mounted on the base and having a primary end connected to the second end of the elongate arm, and a control portion operatively connected to the piston such that when the golf ball unit is struck, the golf ball unit and elongate arm travel through an arc and rotate the shaft unit, such that the primary end and the control portion of the shaft unit rotate, and such that the rotation of the control portion moves the piston in the chamber to slow the rotation of the shaft unit.

Figure 1:
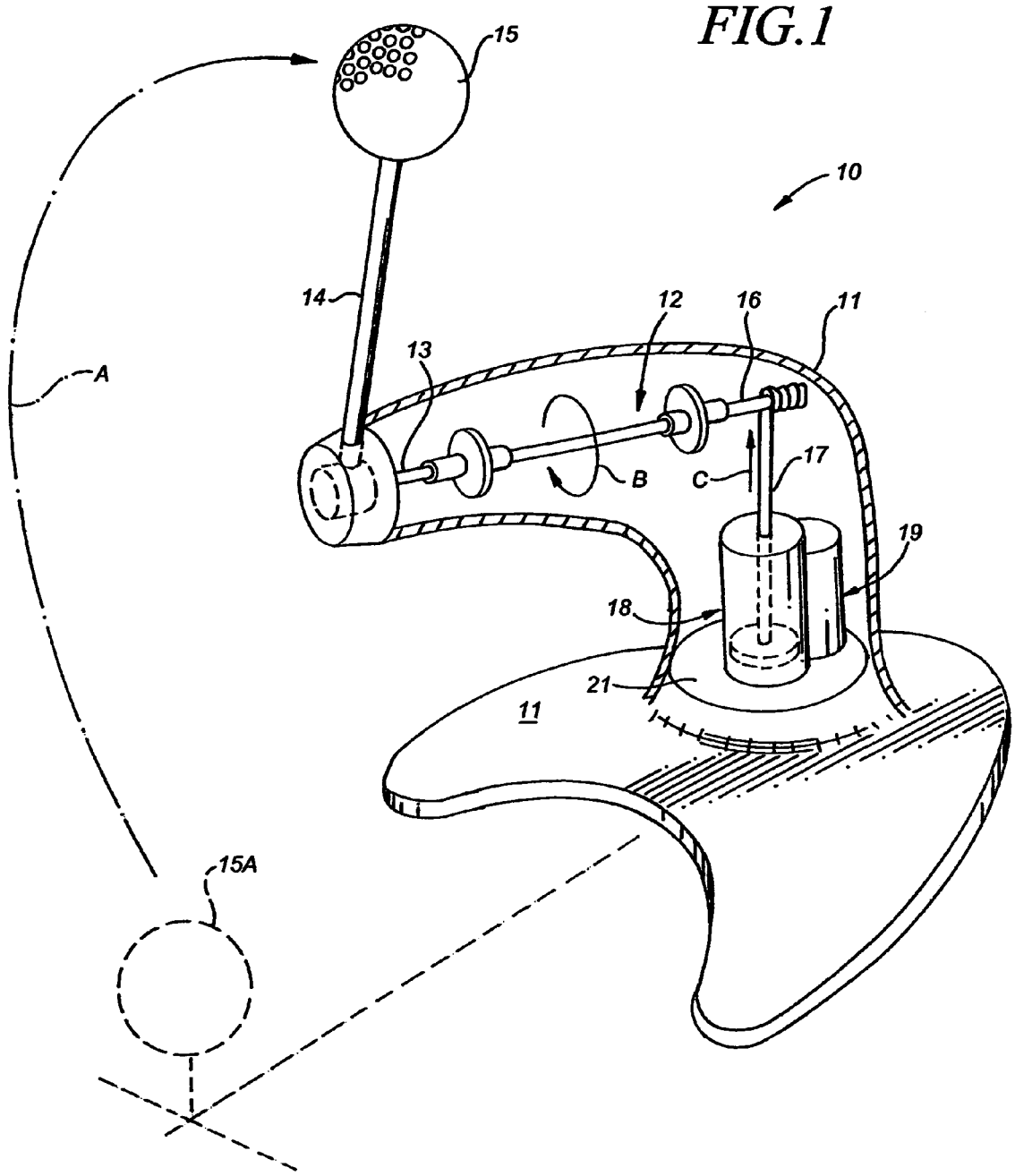
FIG. 1 is a perspective view illustrating a golf practice device constructed in accordance with the principles of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates apparatus constructed in accordance with the principles of the invention and generally indicated by reference character 10. Apparatus 10 includes a base 11. Base 11 is configured to be mounted on the ground, or on a floor. As would be appreciated by those of skill in the art, base 11 can be configured to be mounted on a wall or other surface.

Golf ball unit 15 is connected to one end of elongate arm 14. The second end of arm 15 is connected to the primary end 13 of shaft unit 12. A portion 16 of shaft unit 12 is operatively connected by cable 17 to a piston 20 in chamber 18. Chamber 18 and operatively associated chamber 19 are mounted on floor 21 of base 11. Shaft unit 12 can comprise a single elongate shaft, can comprise a plurality of members linked together in a linear fashion in the manner illustrated in FIG. 1; can comprise a plurality of members linked together in a gear train which may be linear or may be non-linear; etc. Shaft unit 12 must, when golf ball unit 15 is struck and arm 14 and ball unit 15 travel through an arcuate path A, function to produce rotation or another movement that facilitates the displacement of a piston 20 in chamber 18 to slow the movement of unit 12.

Golf ball unit 15 can comprise a regular golf ball or comprise a construction that simulates the appearance and function (when hit) of a conventional golf ball.

The construction of arm 14 can vary as desired, but presently consists of a core of steel cable circumscribed by a polymer, textile or other sheath.

Figure 2:
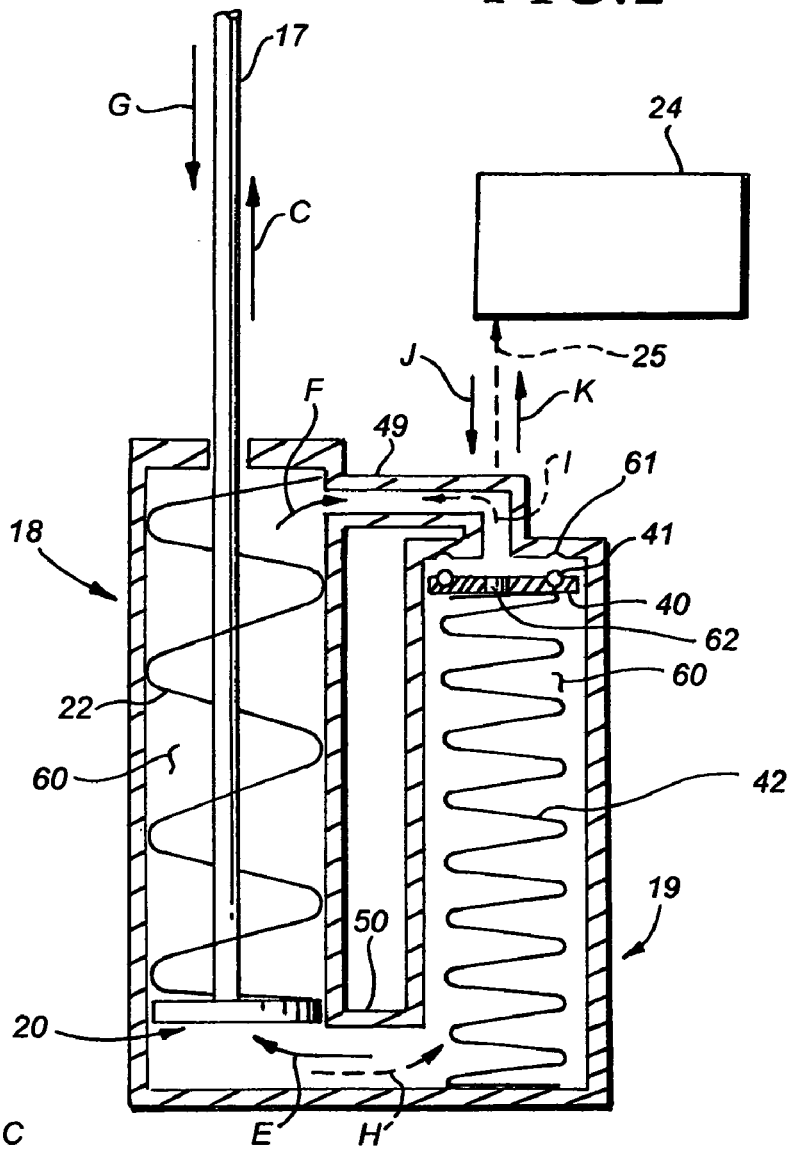
FIG. 2 is a side elevation view of a portion of the device of FIG. 1 illustrating the mode of operation thereof; and, FIG. 3 is a side elevation view illustrating an alternate piston construction in the invention.

Hollow cylindrical chambers 18 and 19 are illustrated in further detail in FIG. 2. Chamber 18 includes dampening apparatus that includes a liquid 60 and a spring 22 interposed between piston 20 and the top of chamber 18. Chamber 19 also is charged with liquid 60. The composition of liquid 60 can vary as desired, but liquid 60 presently preferably comprises an oil. Spring 42 supports flat, cylindrical valve mechanism 40. O-ring 41 is seated in mechanism 40.

Chambers 18 and 19 are interconnected by upper conduit 49 and lower conduit 50 to permit the flow of liquid 60 between chambers 18, 19.

In operation, when ball unit 15 is struck and rotates A through an arc, shaft unit 12 rotates in the direction of arrow B simultaneously with ball unit 15, causing cable 17 to move in the direction of arrow C and wind about portion 16 of shaft unit 12 (FIG. 1). As is illustrated in FIG. 2, when cable 17 unit moves in the direction of arrow C, piston 20 is displaced upwardly simultaneously in the direction of arrow C. Spring 22 and fluid 60 retard the movement of piston 20 upwardly through the interior of chamber 18. Further, when piston 20 moves upwardly, liquid 20 flows in the direction of arrow F through conduit 49 into chamber 19. The fluid flow from chamber 18 through conduit 49 into chamber 19 downwardly displaces valve mechanism 40 from the top of chamber 19 such that O-ring 41 is spaced apart from circular groove 61 in the manner illustrated in FIG. 2. This permits liquid 60 to flow more freely from conduit 49 into chamber 19. Liquid 60 also flows from chamber 19 through conduit 50 into chamber 18 in the direction of flow indicated by arrow E.

Ball unit 15 can reach the end of its travel in the direction of arrow A either because liquid 60 and spring 22 sufficiently retard the travel of piston 20, or, because piston 20 fully compresses spring 22 against the top of chamber 18. Regardless of what causes cessation of the rotation of ball unit 15, once such cessation occurs, spring 22 begins to displace downwardly piston 20 in the direction of arrow G, which pulls cable 17 in the direction of arrow G. This causes shaft unit 12 to rotate in a direction opposite that of arrow B (FIG. 1), which causes cable 17 to unwind from portion 16 and causes ball unit 15 and arm 14 to rotate through an arc in a direction opposite that indicated by arrow A so that ball unit 15 eventually returns to the start position indicated by dashed lines 15A in FIG. 1.

When piston 20 moves downwardly in the direction of arrow G, fluid flows through conduit 49 from chamber 19 to chamber 18 in the manner indicated by arrow I (FIG. 2). When fluid flows in the direction of arrow I, spring 42 is sufficiently strong to force valve mechanism 40 upwardly toward the top of chamber 19 such that O-ring 41 seats in circular groove 61. When O-ring 41 seats in groove 61, the flow of fluid from chamber 18 to 19 through conduit 49 is slowed, because fluid can only move through smaller aperture 62 formed in valve mechanism 40. The ability of fluid to flow only through smaller aperture 62 also slows the return of fluid from chamber 18 to chamber 19 via conduit 50 in the manner indicated by arrow H.

In an alternate construction of the invention, chamber 19 is not connected to chamber 18 via conduit 49. Conduit 49 is removed, and, instead, chamber 18 is connected 25 to a chamber 24 filled with pressurized air or another pressurized gas or liquid. In this alternate construction, when piston 20 is displaced upwardly in the direction of arrow C, the pressurized gas in chamber 24 expands in the direction of arrow J and helps "push" fluid 60 from chamber 19 to chamber 18 in the direction of arrow E. Then when the direction of travel of piston 20 is reversed, and piston 20 travels downwardly in the direction of arrow G, fluid 60 travels back into chamber 19 and forces pressurized gas back into chamber 24 in the direction of arrow K.

Figure 3:
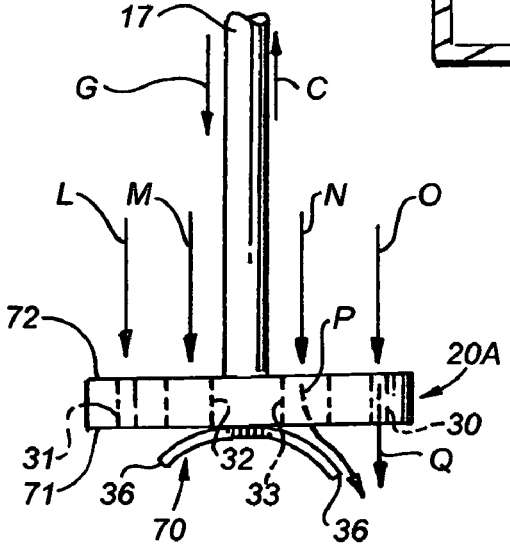

FIG. 3 illustrates an alternate embodiment of the invention in which chamber 19 is completely dispensed with and only chamber 18, piston 20, spring 22, and fluid 60 are utilized. Chamber 18 and fluid 60 are omitted from FIG. 3 for the sake of clarity. The particular construction of piston 20 utilized in this embodiment of the invention is indicated by reference character 20A in FIG. 3. Apertures 30 to 33 are formed through piston 20. The center of a circular resilient rubber valve member 70 is fixedly secured to the bottom of cylindrical piston 20, but the outer peripheral portion of member 70, including circular peripheral edge 36, is free to be displaced resiliently outwardly and downwardly from the bottom 71 of piston 20A in the manner illustrated in FIG. 3. Consequently, when piston 20A is displaced upwardly in the direction of arrow C, liquid 60 impinges against the upper surface 72 of piston 20A in the manner indicated by arrows L, M, N, O. Some of the liquid 60 flows through apertures 32 and 33 and displaces the peripheral portions of member 70 away from bottom 71 to facilitate the flow of liquid 60 through apertures 32 and 33 in the manner indicated by arrow P. This facilitates the movement of piston 20A in the direction of arrow C. Liquid 60 also flows through apertures 30 and 31 in the manner indicated by arrow Q.

When, however, the direction of travel of piston 20A is reversed, and piston 20A and cable 17 travel in the direction of arrow G (which travel is caused by spring 22, which spring 22 is omitted from FIG. 3 for the sake of clarity), liquid 60 located beneath piston 20 generates forces acting upwardly against valve member 70 and causes the peripheral portions of member 20 to press and seat against the bottom 71 of piston 20 so that liquid 60 can not travel through apertures 32 and 33. As a result, liquid 60 can only travel through apertures 30 and 31 in a direction of travel opposite that indicated by arrow Q, i.e. can travel through apertures 30 and 31 in a direction of travel equivalent to the direction of travel indicated by arrow C. This retards movement of piston 20A in the direction of arrow G.

One principal advantage of the apparatus of the invention is that the spring 22—fluid 60 combination is effective in rather quickly slowing the rotation of ball unit 15 after ball unit 15 is struck with a golf club, so that a golfer need not wait a long time before the ball unit 15 is in the position indicated by dashed lines 15A in FIG. 1 and can again be struck with a golf club. The apparatus of the invention also safely slows the movement of ball unit 15 on its return to the "ready" position indicated by dashed lines 15A.

Having described my invention in such terms as to enable those of skill in the art to make and practice it, and having described the presently preferred embodiments thereof,

We claim:

1. Apparatus for practicing a golf swing, comprising (a) a base;

(b) a chamber mounted on said base;

(c) dampening apparatus in said chamber;

(d) a piston in said chamber for reciprocation therein, said dampening apparatus retarding movement of said piston in said chamber;

(e) a golf ball unit;

(f) an elongate arm having a first end connected to said golf ball unit and having a second end;

(g) a shaft unit pivotally mounted on said base and having (i) a primary end connected to said second end of said elongate arm, and (ii) a portion operatively connected to said piston such that when said golf ball unit is struck, (h) said golf ball unit and elongate arm travel through an arc and rotate said shaft unit, (i) said first end and said portion of said shaft unit rotate, and (j) said rotation of said portion displaces said piston in said chamber to slow said rotation of said shaft unit.

* * * * *